US011242864B2

(12) United States Patent
Anderson et al.

(10) Patent No.: US 11,242,864 B2
(45) Date of Patent: Feb. 8, 2022

(54) ASYMMETRIC DOUBLE INLET BACKWARD CURVED BLOWER

(71) Applicant: Carrier Corporation, Jupiter, FL (US)

(72) Inventors: Jackie S. Anderson, Manlius, NY (US); Peter R. Bushnell, Cazenovia, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 288 days.

(21) Appl. No.: 16/339,684

(22) PCT Filed: Oct. 18, 2017

(86) PCT No.: PCT/US2017/057182
§ 371 (c)(1),
(2) Date: Apr. 4, 2019

(87) PCT Pub. No.: WO2018/075635
PCT Pub. Date: Apr. 26, 2018

(65) Prior Publication Data

US 2020/0072237 A1 Mar. 5, 2020

Related U.S. Application Data

(60) Provisional application No. 62/409,669, filed on Oct. 18, 2016.

(51) Int. Cl.
*F04D 29/28* (2006.01)
*F04D 29/42* (2006.01)

(52) U.S. Cl.
CPC ..... *F04D 29/424* (2013.01); *F04D 29/281* (2013.01)

(58) Field of Classification Search
CPC ..... F04D 29/281; F04D 29/282
See application file for complete search history.

(56) References Cited

U.S. PATENT DOCUMENTS 5,558,499 A 9/1996 Kobayashi
7,108,482 B2 9/2006 Chapman
(Continued)

FOREIGN PATENT DOCUMENTS

CN 1862029 A 11/2006
CN 101846087 A 9/2010
(Continued)

OTHER PUBLICATIONS

Branson, "Contoured Infrared Technology: Non Contact Plastic Welding for Particulate-free and Aesthetically Clean Joints," Emerson Industrial Automation; 2013; pp. 1-6.
(Continued)

*Primary Examiner* — David E Sosnowski
*Assistant Examiner* — Sabbir Hasan
(74) *Attorney, Agent, or Firm* — Cantor Colburn LLP

(57) ABSTRACT

A blower assembly includes a blower housing and a fan wheel mounted within the blower housing and being rotatable about an axis of rotation. The fan wheel includes a support disk positioned near a center of the fan wheel. A first wheel portion having a first plurality of impeller blades is positioned adjacent a first side of the support disk. A second wheel portion having a second plurality of impeller blades is positioned adjacent a second side of the support disk. The first wheel portion and the second wheel portion are asymmetrical about a plane oriented perpendicular to the axis of rotation and intersecting the support disk.

22 Claims, 11 Drawing Sheets

(56) References Cited

U.S. PATENT DOCUMENTS

| | | | | |
|---|---|---|---|---|
| 7,563,074 | B2 | 7/2009 | Xu | |
| 7,762,778 | B2 | 7/2010 | Purvines | |
| 8,100,637 | B2 | 1/2012 | Sinzaki | |
| 8,133,009 | B2 | 3/2012 | Salvesen | |
| 8,177,484 | B2 | 5/2012 | Haraguchi et al. | |
| 8,337,157 | B2 | 12/2012 | Kilian et al. | |
| 8,684,661 | B2 * | 4/2014 | Horng | F04D 17/04 415/53.1 |
| 9,109,605 | B2 | 8/2015 | Chou | |
| 9,109,610 | B2 | 8/2015 | Streng et al. | |
| 9,140,270 | B2 | 9/2015 | Hong | |
| 9,447,790 | B2 | 9/2016 | Nakai et al. | |
| 9,689,264 | B2 | 6/2017 | Cocks et al. | |
| 9,933,185 | B2 | 4/2018 | Kameyama et al. | |
| 10,704,554 | B2 | 7/2020 | Nakai et al. | |
| 2002/0182079 | A1 | 12/2002 | Gerken et al. | |
| 2008/0279682 | A1 | 11/2008 | Wydra | |
| 2010/0158689 | A1 | 6/2010 | Nishino | |
| 2011/0243720 | A1 | 10/2011 | Post | |
| 2012/0093650 | A1 | 4/2012 | Martin et al. | |
| 2012/0156024 | A1 | 6/2012 | Horng et al. | |
| 2013/0089425 | A1 | 4/2013 | Wu | |
| 2013/0170945 | A1 | 7/2013 | Gatley, Jr. et al. | |
| 2015/0071800 | A1 | 3/2015 | Lee et al. | |
| 2016/0115967 | A1 | 4/2016 | Kurihara et al. | |
| 2017/0107997 | A1 | 4/2017 | Yamamoto et al. | |
| 2019/0234418 | A1 | 8/2019 | Rau et al. | |

FOREIGN PATENT DOCUMENTS

| | | | |
|---|---|---|---|
| CN | 202851448 | U | 4/2013 |
| CN | 103696985 | A | 4/2014 |
| CN | 103807209 | A | 5/2014 |
| CN | 203685679 | U | 7/2014 |
| CN | 203879799 | U | 10/2014 |
| CN | 203879801 | U | 10/2014 |
| CN | 104747495 | A | 7/2015 |
| CN | 104806567 | A | 7/2015 |
| CN | 105090107 | A | 11/2015 |
| CN | 105179281 | A | 12/2015 |
| CN | 204961385 | U | 1/2016 |
| DE | 3247453 | C1 | 12/1983 |
| EP | 0348846 | A2 | 1/1990 |
| EP | 1933040 | A1 | 6/2008 |
| JP | S5117005 | A | 2/1976 |
| JP | S55114897 | A | 9/1980 |
| JP | 4507553 | B2 | 7/2010 |
| WO | 2013092289 | A1 | 6/2013 |
| WO | 2014109108 | A1 | 7/2014 |
| WO | 2015064514 | A1 | 5/2015 |
| WO | 2017073593 | A1 | 5/2017 |

OTHER PUBLICATIONS

PCT ISR Written Opinion; International Application No. PCT/US2017/057182; International Filing Date: Oct. 18, 2017; dated Jan. 26, 2018; pp. 1-6.

PCT Notification of Transmittal of International Search Report; International Application No. PCT/US2017/057182; International Filing Date: Oct. 18, 2017; dated Jan. 26, 2018; pp. 1-5.

Extended European Search Report; International Application No. 19154328.9-1007; International Filing Date: Jan. 29, 2019; dated Jun. 26, 2019; 9 pages.

Notice of Allowance; U.S. Appl. No. 16/246,939, filed Jan. 14, 2019; dated Feb. 18, 2021; 27 pages.

U.S. Non-Final Office Action; U.S. Appl. No. 16/246,939, filed Jan. 14, 2019; dated Oct. 28, 2020; 29 pages.

* cited by examiner

ASYMMETRIC DOUBLE INLET BACKWARD CURVED BLOWER

CROSS REFERENCE TO RELATED APPLICATIONS

This application is a National Stage application of PCT/US2017/057182, filed Oct. 18, 2017, which claims the benefit of U.S. Provisional Application No. 62/409,669, filed Oct. 18, 2016, both of which are incorporated by reference in their entirety herein.

BACKGROUND

The disclosure relates generally to heating and cooling systems and, more particularly, to a fan wheel of a blower assembly configured for use in such heating and cooling systems.

Heating, ventilation and air conditioning and refrigeration (HVAC & R) systems typically use a blower driven by a blower motor to supply air through ducts. HVAC & R systems are typically designed to provide an amount of airflow expressed as cubic feet per minute (CFM) (cubic meters per second in SI units). Conventionally, HVAC & R systems use a forward curved centrifugal fan to drive airflow to the other components of the system. However, there is a need to increase the efficiency of the blower without increasing the size of the housing of the HVAC & R system.

BRIEF DESCRIPTION

According to an embodiment, a blower assembly includes a blower housing and a fan wheel mounted within the blower housing and being rotatable about an axis of rotation. The fan wheel includes a support disk positioned near a center of the fan wheel. A first wheel portion having a first plurality of impeller blades is positioned adjacent a first side of the support disk. A second wheel portion having a second plurality of impeller blades is positioned adjacent a second side of the support disk. The first wheel portion and the second wheel portion are asymmetrical about a plane oriented perpendicular to the axis of rotation and intersecting the support disk.

In addition to one or more of the features described above, or as an alternative, in further embodiments at least one of a number of impeller blades, a blade angle, blade height, inlet diameter, and chord of the first wheel portion is different than the second wheel portion.

In addition to one or more of the features described above, or as an alternative, in further embodiments a configuration of the first wheel portion is optimized for integration with a motor and a configuration of the second wheel portion is optimized for maximum fan efficiency.

In addition to one or more of the features described above, or as an alternative, in further embodiments the first plurality of impeller blades is greater in number than the second plurality of impeller blades.

In addition to one or more of the features described above, or as an alternative, in further embodiments a blade angle of the first plurality of impeller blades is greater than a blade angle of the second plurality of impeller blades.

In addition to one or more of the features described above, or as an alternative, in further embodiments an inlet diameter defined by the first plurality of impeller blades is greater than an inlet diameter defined by the second plurality of impeller blades.

In addition to one or more of the features described above, or as an alternative, in further embodiments at least one of the first plurality of impeller blades and the second plurality of impeller blades has a backward curved configuration.

In addition to one or more of the features described above, or as an alternative, in further embodiments the first plurality of impeller blades includes between about 8 and about 19 impeller blades.

In addition to one or more of the features described above, or as an alternative, in further embodiments the first plurality of impeller blades have an outlet blade angle between 35° and 55°.

In addition to one or more of the features described above, or as an alternative, in further embodiments the first wheel portion has a diameter ratio between about 0.6 and about 0.8.

In addition to one or more of the features described above, or as an alternative, in further embodiments the first plurality of impeller blades have a blade height ratio between about 1.2 and 1.8.

In addition to one or more of the features described above, or as an alternative, in further embodiments the first plurality of impeller blades have a thickness between about 2 mm and about 5 mm.

In addition to one or more of the features described above, or as an alternative, in further embodiments the second plurality of impeller blades includes between about 15 and about 30 impeller blades.

In addition to one or more of the features described above, or as an alternative, in further embodiments the second plurality of impeller blades have an outlet blade angle between 45° and 75°.

In addition to one or more of the features described above, or as an alternative, in further embodiments the second wheel portion has a diameter ratio between about 0.7 and about 0.9.

In addition to one or more of the features described above, or as an alternative, in further embodiments the second plurality of impeller blades have a blade height ratio between about 1.0 and about 1.6.

In addition to one or more of the features described above, or as an alternative, in further embodiments the second plurality of impeller blades have a thickness between about 2 mm and about 5 mm.

In addition to one or more of the features described above, or as an alternative, in further embodiments comprising a first shroud ring coupled to a distal end of the first plurality of impeller blades.

In addition to one or more of the features described above, or as an alternative, in further embodiments comprising a second shroud ring coupled to a distal end of the second plurality of impeller blades.

In addition to one or more of the features described above, or as an alternative, in further embodiments the first shroud ring includes a plurality of openings configured to receive the distal end of the first plurality of impeller blades.

In addition to one or more of the features described above, or as an alternative, in further embodiments the distal end of the first plurality of impeller blades includes a feature complementary to the plurality of openings such that when the feature is inserted into an opening movement of the first impeller blade is restricted.

In addition to one or more of the features described above, or as an alternative, in further embodiments comprising a motor for driving rotation of the fan wheel about an axis, wherein the first wheel portion defines a cavity within which a portion of the motor is received.

In addition to one or more of the features described above, or as an alternative, in further embodiments a plurality of mounting brackets couple the motor to a sidewall of the blower housing.

In addition to one or more of the features described above, or as an alternative, in further embodiments the blower is a portion of a furnace or an air handling unit.

These and other advantages and features will become more apparent from the following description taken in conjunction with the drawings.

BRIEF DESCRIPTION OF THE DRAWING

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

Figure 1:
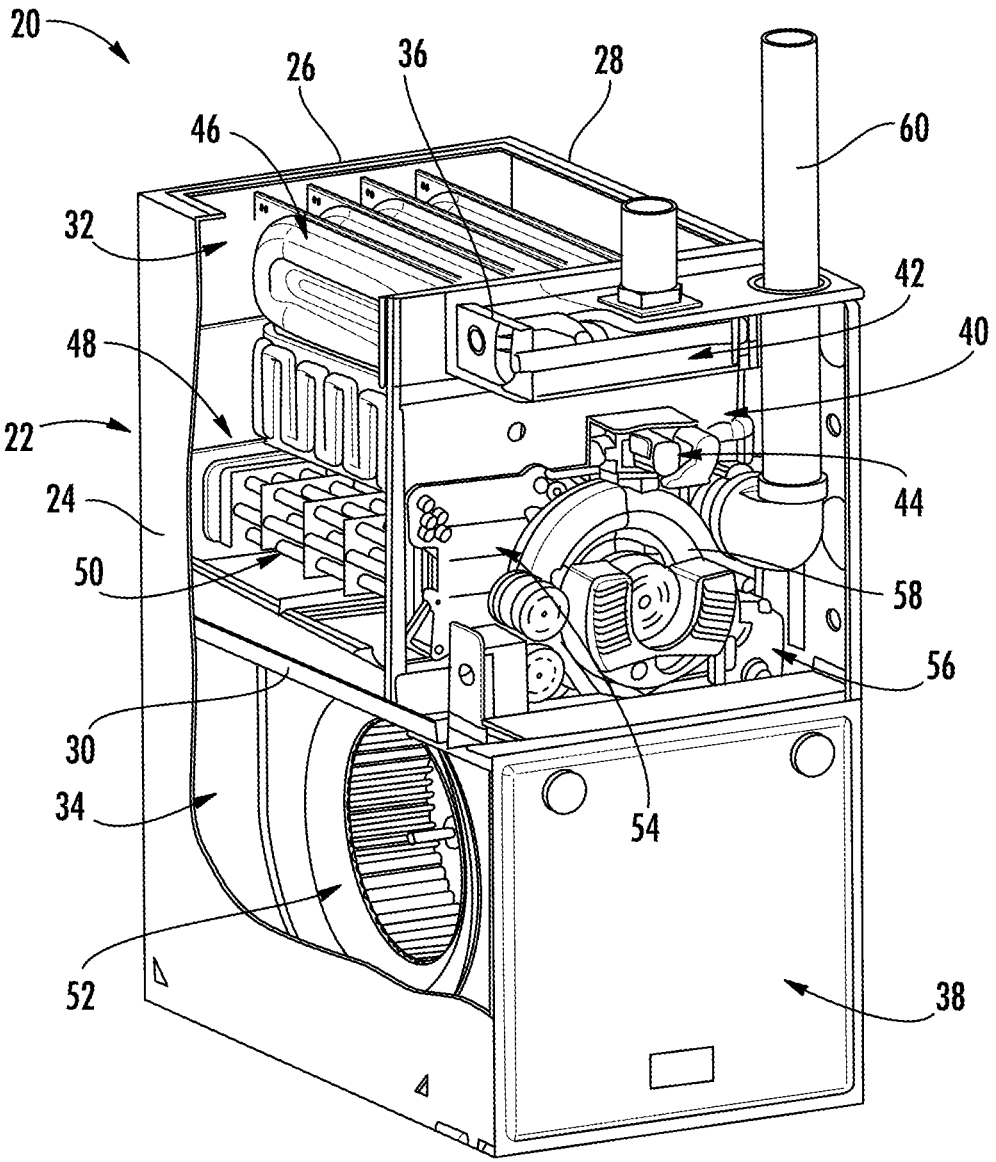
FIG. 1 is a perspective view of an example of a gas furnace system.

With reference to FIG. 1, an example of a gas furnace system is illustrated generally at 20. The gas furnace system 20 includes a housing 22 having a plurality of exterior walls 24, 26, 28 and an interior dividing wall 30 that forms a heat exchange portion 32 and a blower portion 34. Heat exchange portion 32 includes a component support wall 36 which, as will be discussed more fully below, provides structure for mounting various components of the gas furnace system 20. Housing 22 is also shown to include an access panel 38 that provides access to the blower portion 34 and another access panel (not shown) that provides access to heat exchange portion 32.

The gas furnace system 20 additionally includes a burner assembly 40 mounted to component support wall 36. Burner assembly 40 includes a burner box 42 and a gas valve 44. Burner assembly 40 combusts a fuel, in the form of gas, to generate heat used to condition a comfort zone such as living spaces, work spaces and the like. As will be discussed more fully below, products of combustion or exhaust gases generated by the burning of the fuel are expelled to ambient. In the embodiment shown, burner assembly 40 is operatively connected to a primary heat exchanger 46 arranged within heat exchange portion 32. Primary heat exchanger 46 is operatively coupled to a condensing heat exchanger 48. Condensing heat exchanger 48 includes a plurality of heat exchange members 50. With this arrangement, a blower assembly 52 arranged within the blower portion 34 draws in air from a space to be heated. The air is guided over primary heat exchanger 46 and heat exchange members 50 of condensing heat exchanger 48 such that the air is heated before being re-introduced into the space.

During operation of the gas furnace system 20, moisture from the products of combustion condenses condensing heat exchanger 48. This moisture collected and passed on to an external drain (not shown). The moisture is guided to a condensate collector box 54. Condensate collector box 54 is secured to component support wall 36. The moisture is collected in condensate collector box 54 and passed to a condensate trap 56 and on to the external drain. Gas furnace system 20 further includes an inducer fan assembly 58 mounted to condensate collection box 52. Inducer fan assembly 58 creates an air flow that establishes a draft which draws the products of combustion from burner box 32 through heat exchanger 40 and heat exchange members 46 of condensing heat exchanger 48. More specifically, inducer fan assembly 58 produces a pressure rise and flow rate to achieve a desired combustion performance while overcoming flow losses within gas furnace system 20. The products of combustion are then exhausted through a flue vent 60.

Figure 2:
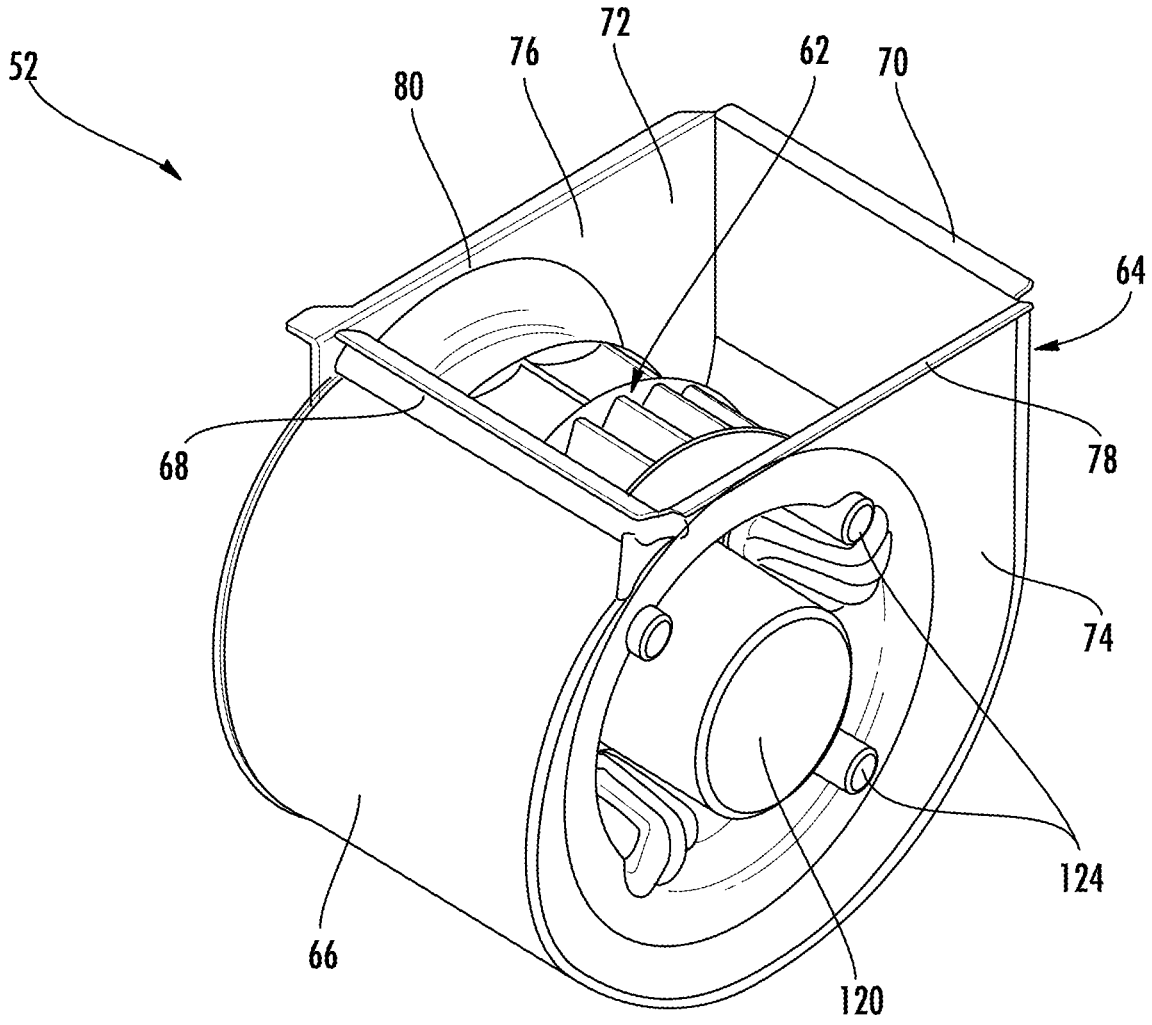
FIG. 2 is a perspective view of a blower assembly of the gas furnace system according to an embodiment.
Figure 3:
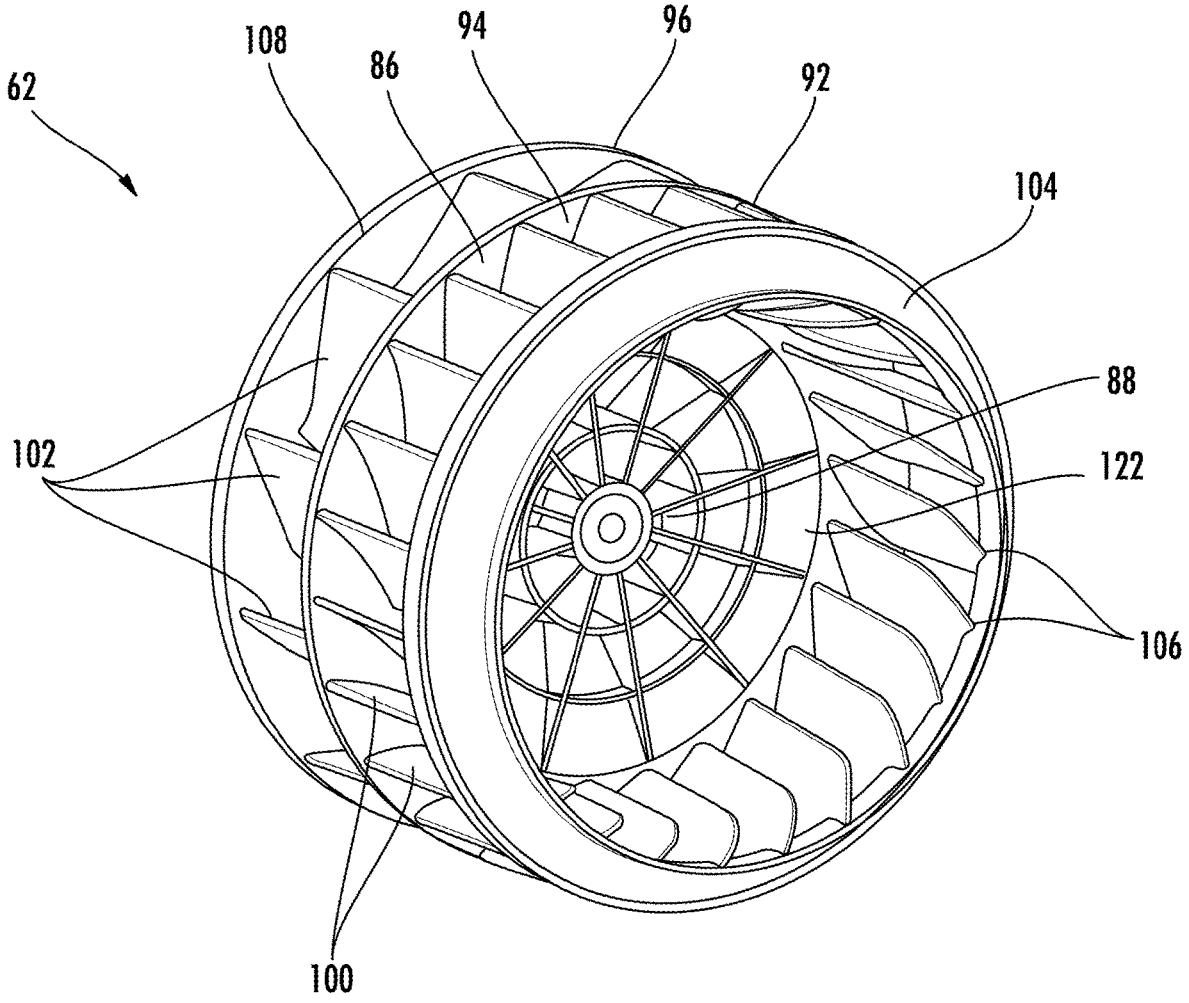
FIG. 3 is a perspective view of a fan wheel of the blower assembly according to an embodiment.

With reference now to FIG. 2, the blower assembly 52 is illustrated in more detail. Although the blower assembly 52 is illustrated and described herein with reference to a furnace, it should be understood that the blower assembly 52 may be used in other suitable applications, such as in an air handling unit of an HVAC and/or refrigeration system for example. The blower assembly 52 includes a fan wheel 62 positioned within a blower housing 64. The blower housing 64 has an outer wall 66 having a scroll-shaped length that extends from a first end edge 68 of the outer wall 66 to an opposite second end edge 70 of the outer wall 66. The first end edge 68 the second end edge 70 define opposite sides of an outlet opening 72 of the blower housing 64. Although the outlet opening 72 is illustrated as being generally rectangular in shape, embodiments where the outlet opening 72 is another shape are also contemplated herein. The blower housing 64 additionally includes a first sidewall 74 and a second sidewall 76. As seen in FIG. 3, portions of the peripheries of the first sidewall 74 and the second sidewall 76 are connected to opposite sides of the outer wall 66. The first sidewall 74 has a first straight edge portion 78 extending between the outer wall first end edge 68 and the outer wall second end edge 70 and the second sidewall 76 has a second straight edge portion 80 extending between the outer wall first end edge 68 and the outer wall second end edge 70. The first sidewall 74 includes a first aperture 82 and the second sidewall includes a second aperture 84 (best shown in FIG. 10).

With reference now to FIGS. 3-7, the fan wheel 62 is illustrated in more detail. The fan wheel 62 includes a support disk 86. The disk 86 may be any suitable type and may include a hub 88 for mounting the wheel 62 to a drive shaft 90 (FIG. 9) for rotation about an axis X. The disk 86 is located near a central portion of the wheel 62 such that a first wheel portion 92 is defined adjacent a first side 94 of the disk 86 and a second wheel portion 96 is defined adjacent a second, opposite side 98 of the disk 86. The first wheel portion 92 includes a first plurality of impeller blades 100 arranged near an outer periphery of the disk 86 and extending generally perpendicular from the first side 94 of the disk 86. Similarly, the second wheel portion 96 includes a second plurality of impeller blades 102 arranged near an outer periphery of the disk 86 and extending generally perpendicular from the second side 98 of the disk 86. As a result, of this configuration, the first plurality of impeller blades 100 is axially spaced from the second plurality of impeller blades 102. In an embodiment, one or both of the first plurality and the second plurality of impeller blades 100, 102 are configured as backward curved impeller blades. When used in a furnace system, such as system 20 of FIG. 1, both the first wheel portion and the second wheel portion are configured to provide air to an adjacent component, and are associated with a single plenum.

Figure 4B:
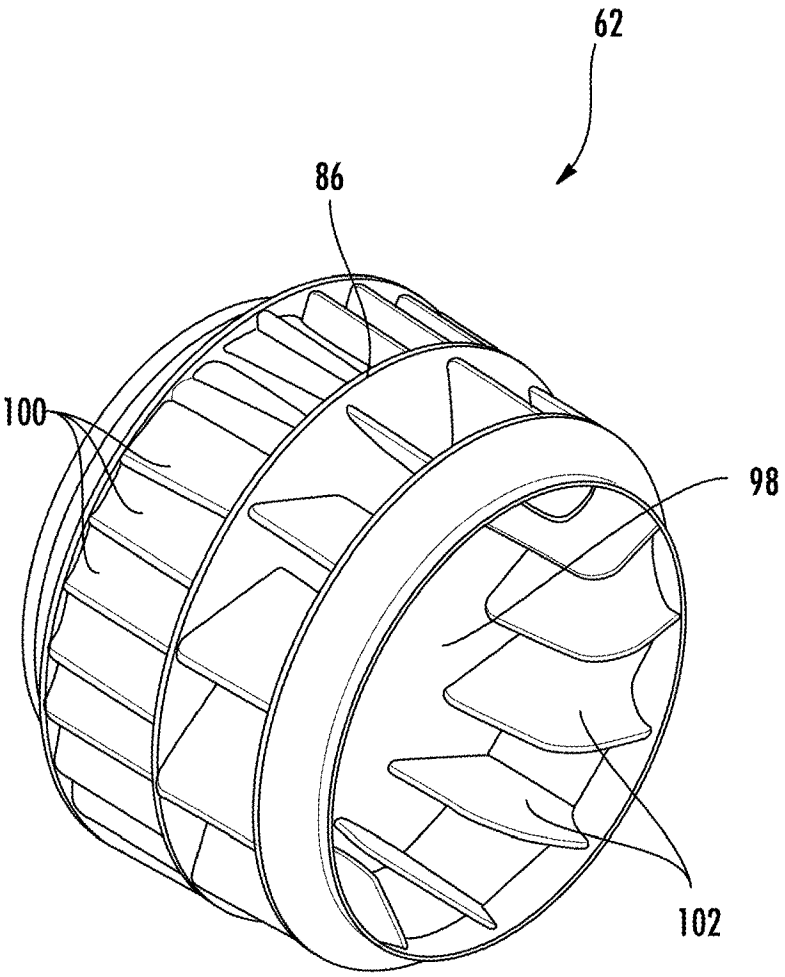
FIGS. 4*a* and 4*b* are various perspective views of the fan wheel of the blower assembly according to an embodiment.
Figure 4A:
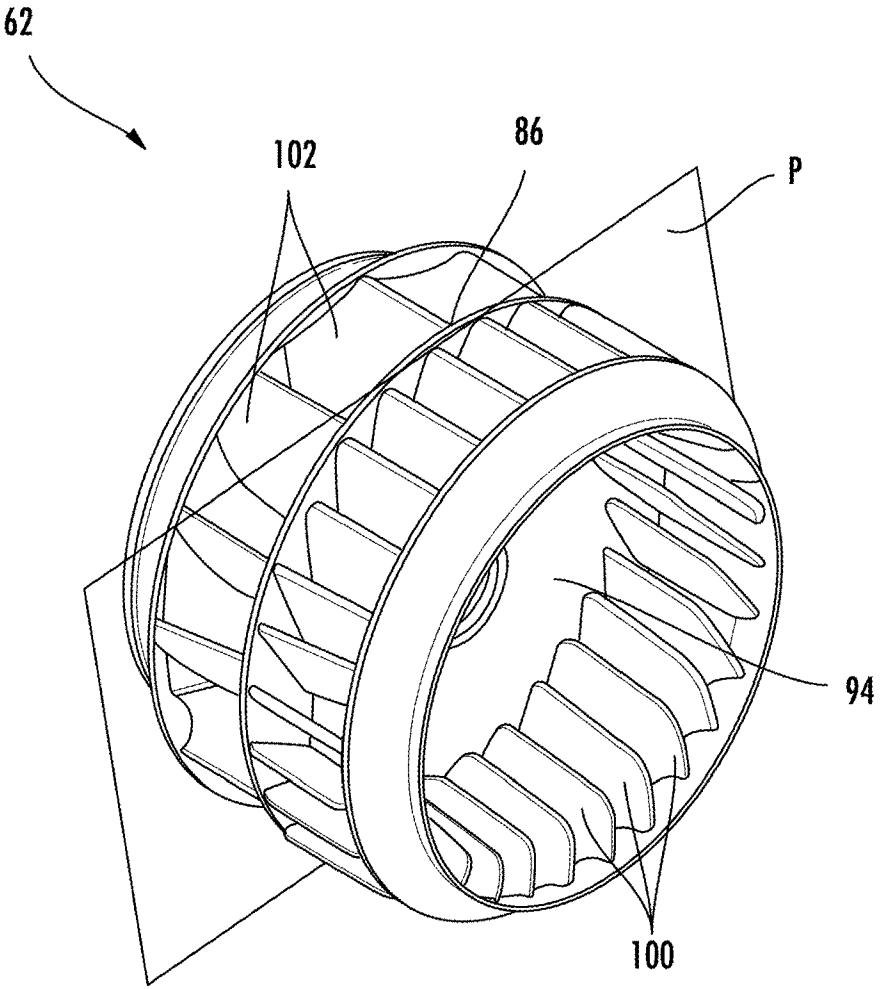
Figure 5B:
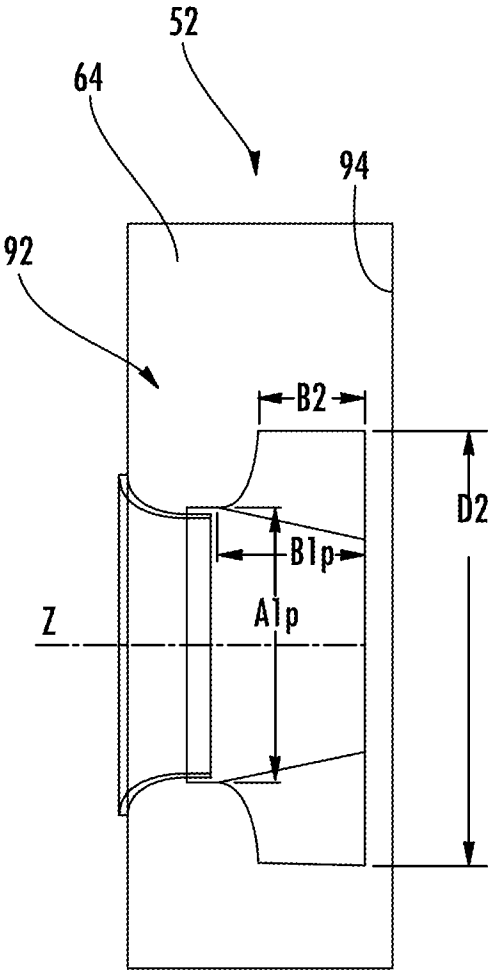
FIGS. 5*a* and 5*b* are various cross-sectional views of the fan wheel of the blower assembly according to an embodiment.
Figure 5A:
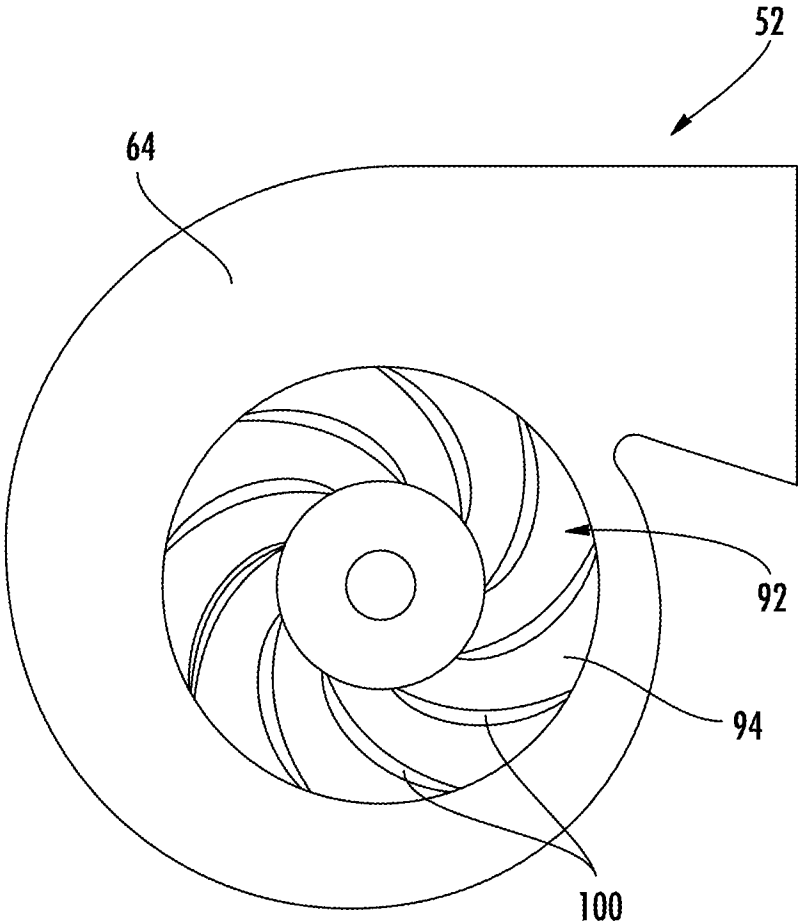
Figure 6:
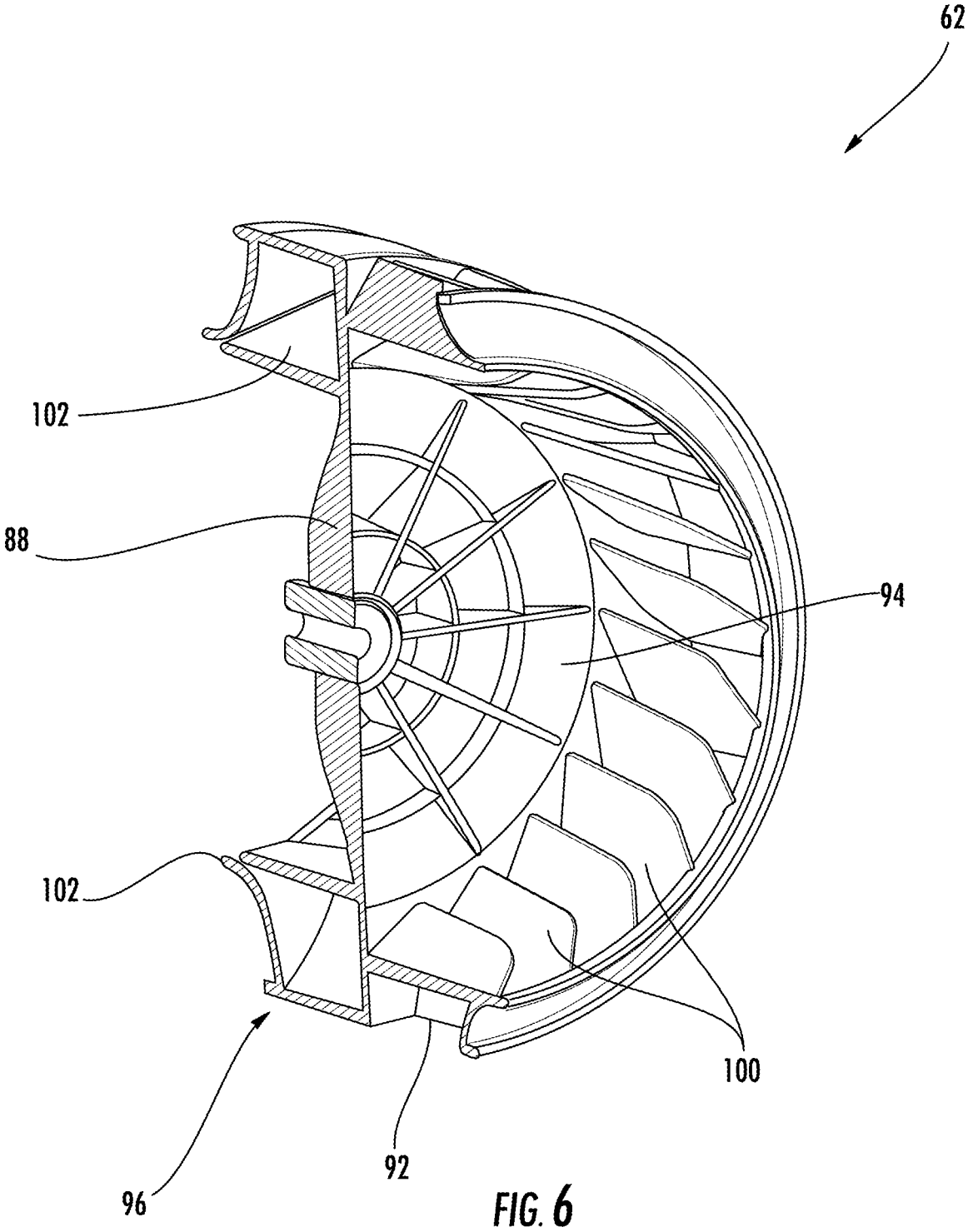
FIG. 6 is a perspective cross-sectional view of the fan wheel of the blower assembly according to an embodiment.

In an embodiment, the first wheel portion 92 is dissimilar from the second wheel portion 96 such that the fan wheel 62 has an asymmetrical configuration about a plane, illustrated schematically at P in FIG. 4A oriented perpendicular to the axis of rotation and intersecting the support disk 86. More specifically, the first plurality of impeller blades 100 and the second plurality of impeller blades 102 are asymmetrical about plane P, oriented parallel to the support disk 86. However, in an embodiment, the first wheel portion 92 and the second wheel portion 96 may be configured to achieve a substantially similar flow rate, such as within 10%. For example, the configuration of the first wheel portion 92 may be optimized for integration with a motor and the configuration of the second wheel portion 96 may be optimized for maximum fan efficiency. For example, such optimization for integration with a motor may include a configuration having a larger inlet diameter, a higher blade count, and a larger blade angle. Similarly, optimization for fan efficiency may include a smaller inlet diameter, a reduced number of blades and a lesser blade angle for example. In an embodiment, the asymmetry of the fan wheel 62 may be achieved by varying the number of blades, the blade angle, the height of the blades, the inlet diameter defined by the blades, and the chord between the first wheel portion 92 and the second wheel portion 96. However, these parameters are intended as an example only and other parameters of the fan wheel 62 or blower assembly 52 may be modified to achieve the desired asymmetry.

In an embodiment, the first wheel portion 92 includes between about 8 and 19 impeller blades, has an outlet blade angle, beta2 (see FIG. 5A), between about 35° and about 55°, a diameter ratio, D1*p*/D2 (see FIG. 5B), between about 0.6-08, and a blade height ratio, B1*p*/B2 (see FIG. 5B), between about 1.2-1.8. Further, the first plurality of impeller blades 100 may have a thickness of about 2 and about 5 mm. Similarly, the second wheel portion 96 may include between about 15 and 30 impeller blades, have an outlet blade angle between about 45° and about 75°, a diameter ratio of about 0.7-0.9, and a blade height ratio of about 1.0-1.6. In an embodiment, a thickness of the second plurality of impeller blades 102 is between about 2 mm and about 5 mm.

Figure 7:
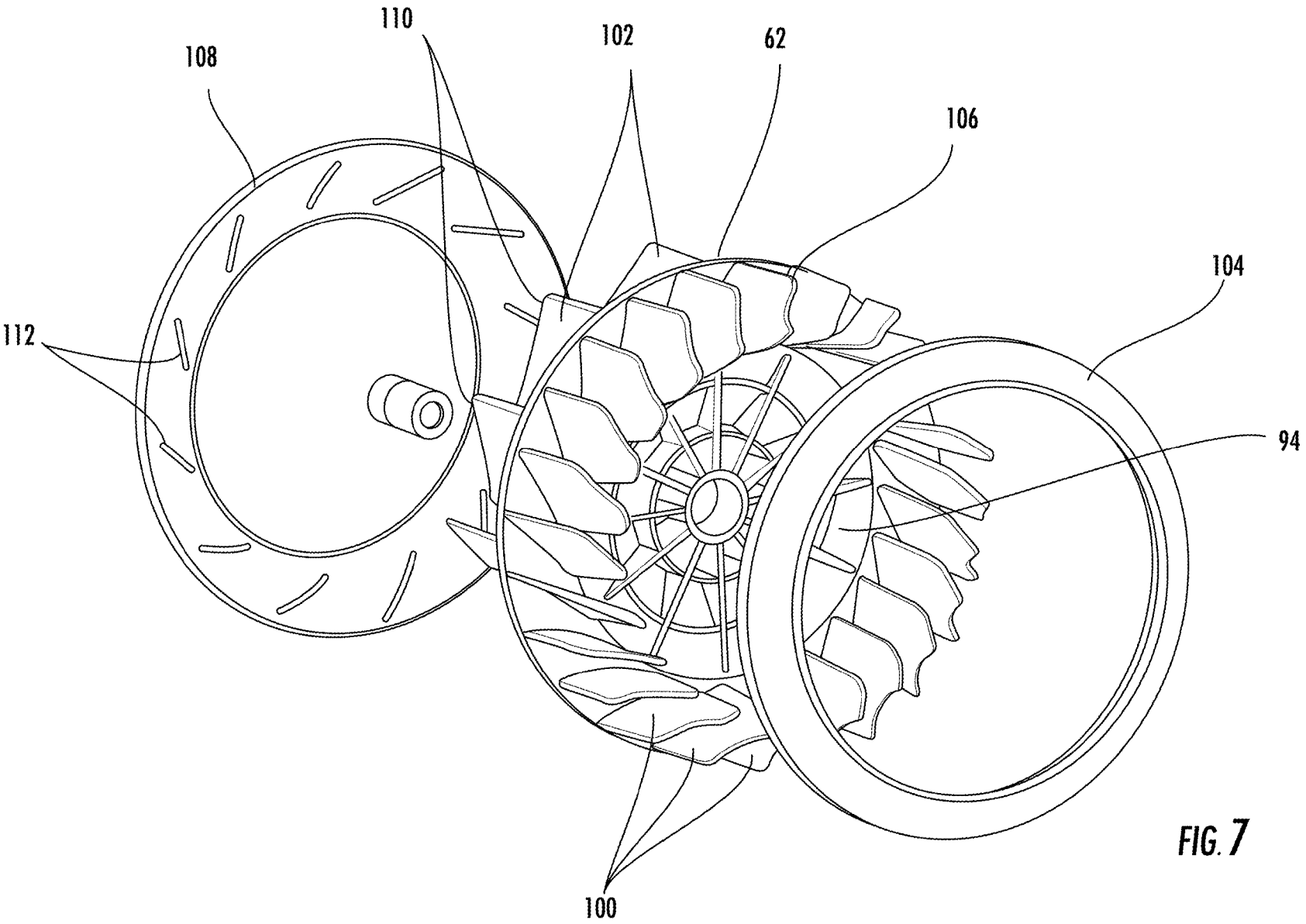
FIG. 7 is an exploded perspective view of the fan wheel of the blower assembly according to an embodiment.

The blower assembly 52 additionally includes a first annular plate or shroud ring 104 coupled to the peripheral edge defined by the free ends 106 of the first plurality of impeller blades 100 and includes a second annular plate or shroud ring 108 coupled to the peripheral edge defined by the free ends 110 of the second plurality of impeller blades 102. In an embodiment, best shown in FIG. 6, at least one of the first shroud ring 104 and the second shroud ring 108 includes a plurality of openings 112 complementary to and configured to align within the first plurality of impeller blades 100 and the second plurality of impeller blades 102, respectively. A feature 114, such as angle or pointed tip as shown in FIG. 7 for example, may be formed at the distal end 106, 110 of the blades 100, 102 to facilitate positioning of the blade 100, 102 relative to an opening 112. In an embodiment, the feature 114 may be designed to restrict motion of the blade 100, 102 relative to the shroud ring 104, 108. After the feature 114 is received within an opening 112 of a directly adjacent shroud ring 104, 108, a fastening mechanism 116, such as an ultrasonic weld or other suitable mechanism, may be applied or formed at the interface to permanently or temporarily affix the shroud ring 104, 108 to the respective plurality of blades 100, 102.

Figure 8:
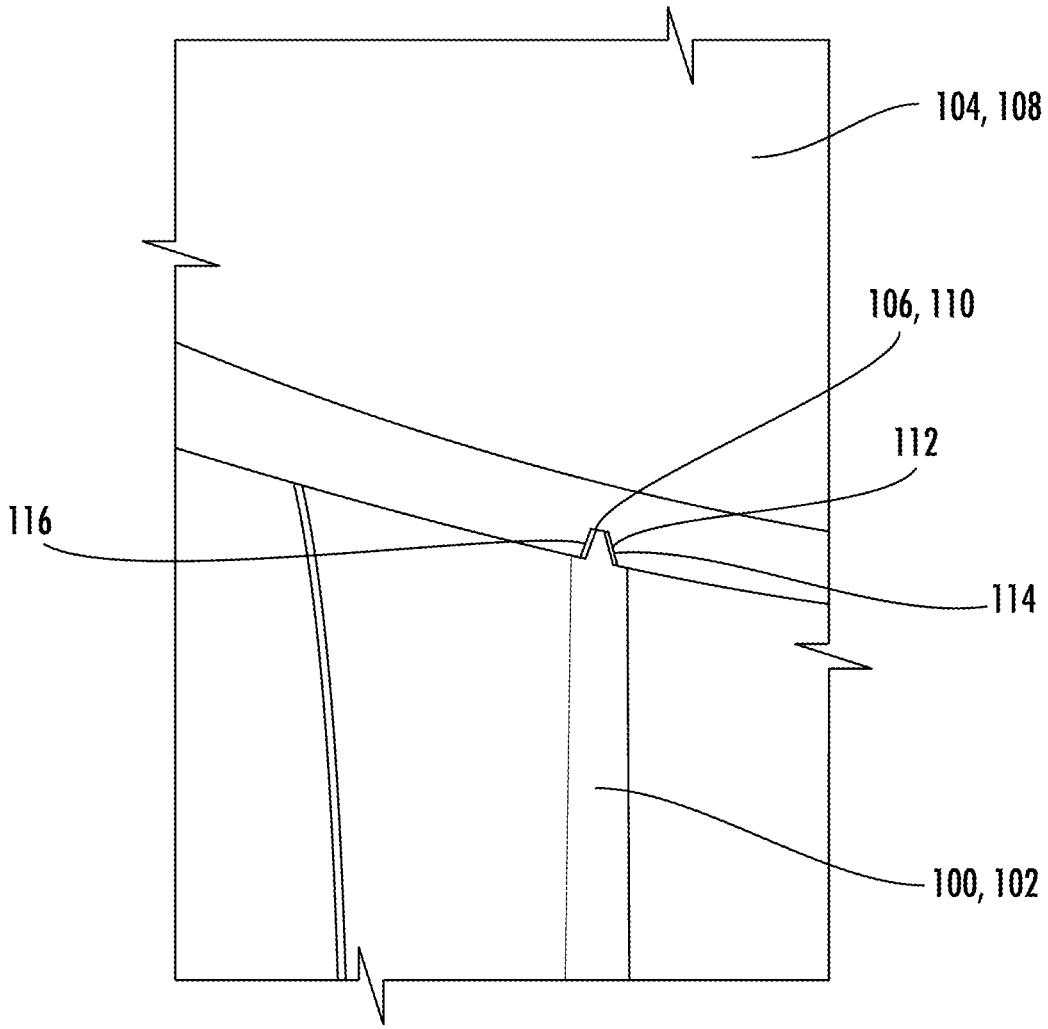
FIG. 8 is a detailed view of the interface between an impeller blade of the fan wheel and an annular plate according to an embodiment.
Figure 9:
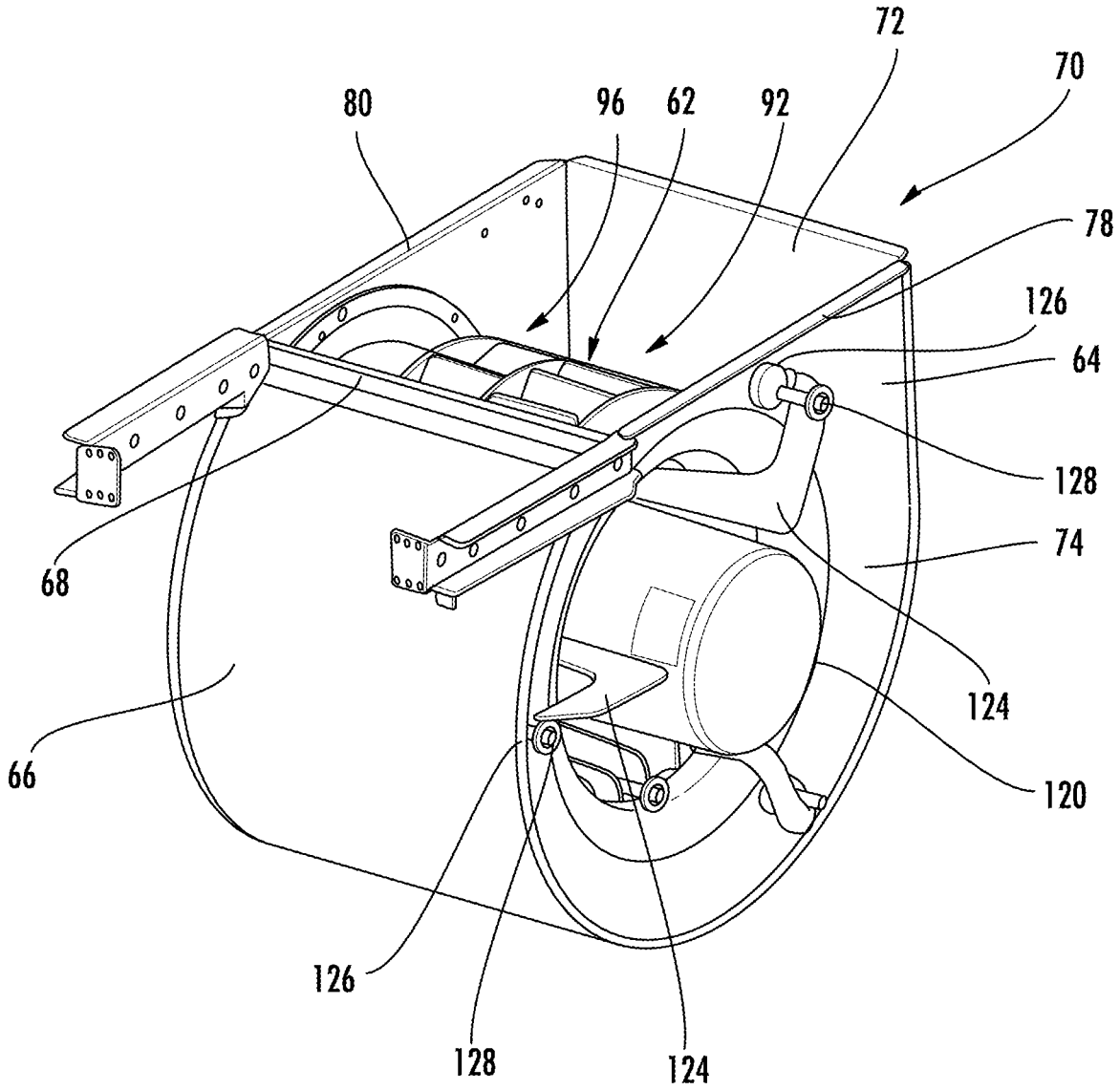
FIG. 9 is a perspective view of a blower assembly according to an embodiment.
Figure 10:
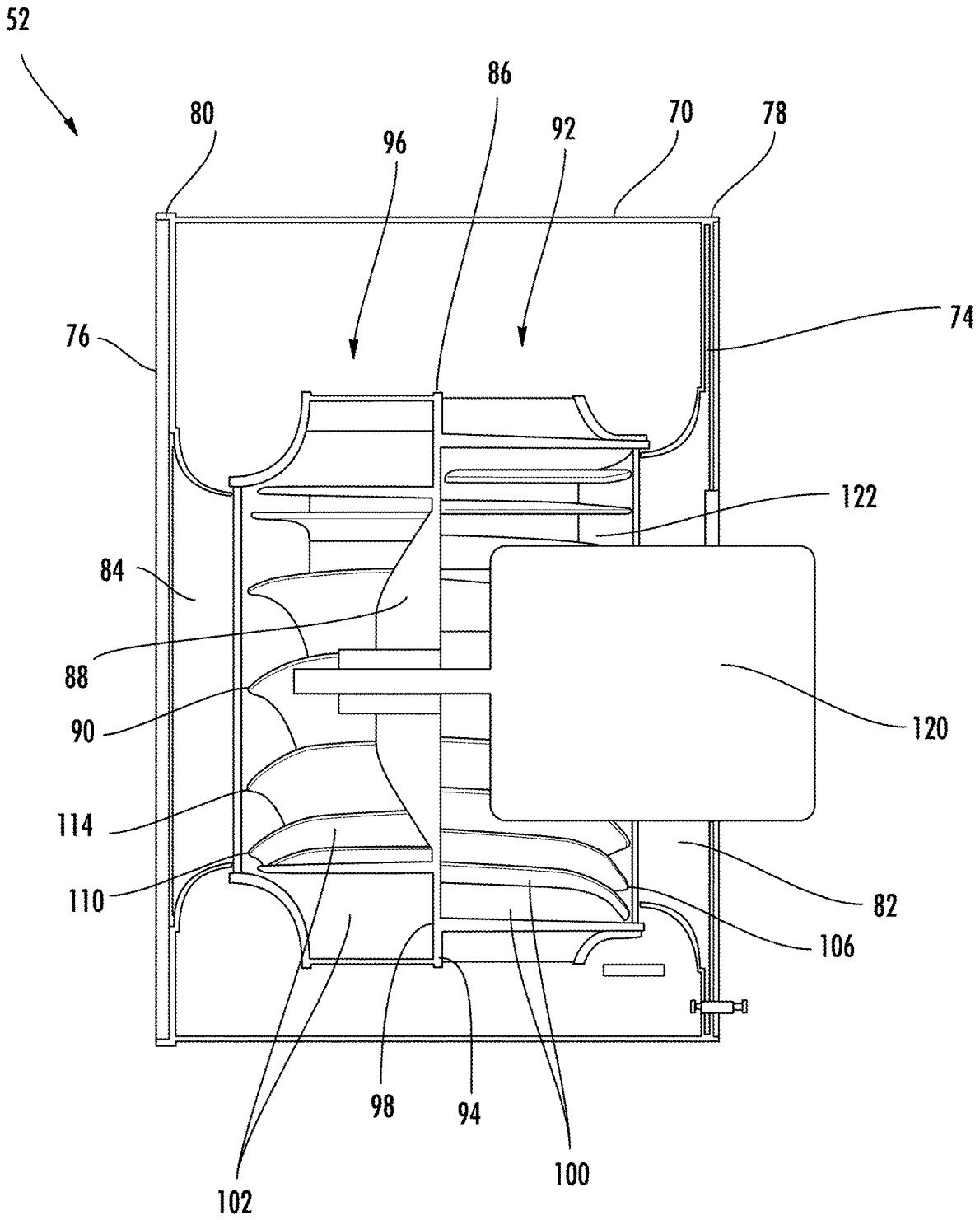
FIG. 10 is a cross-sectional view of the blower assembly of FIG. 8 according to an embodiment.
Figure 11:
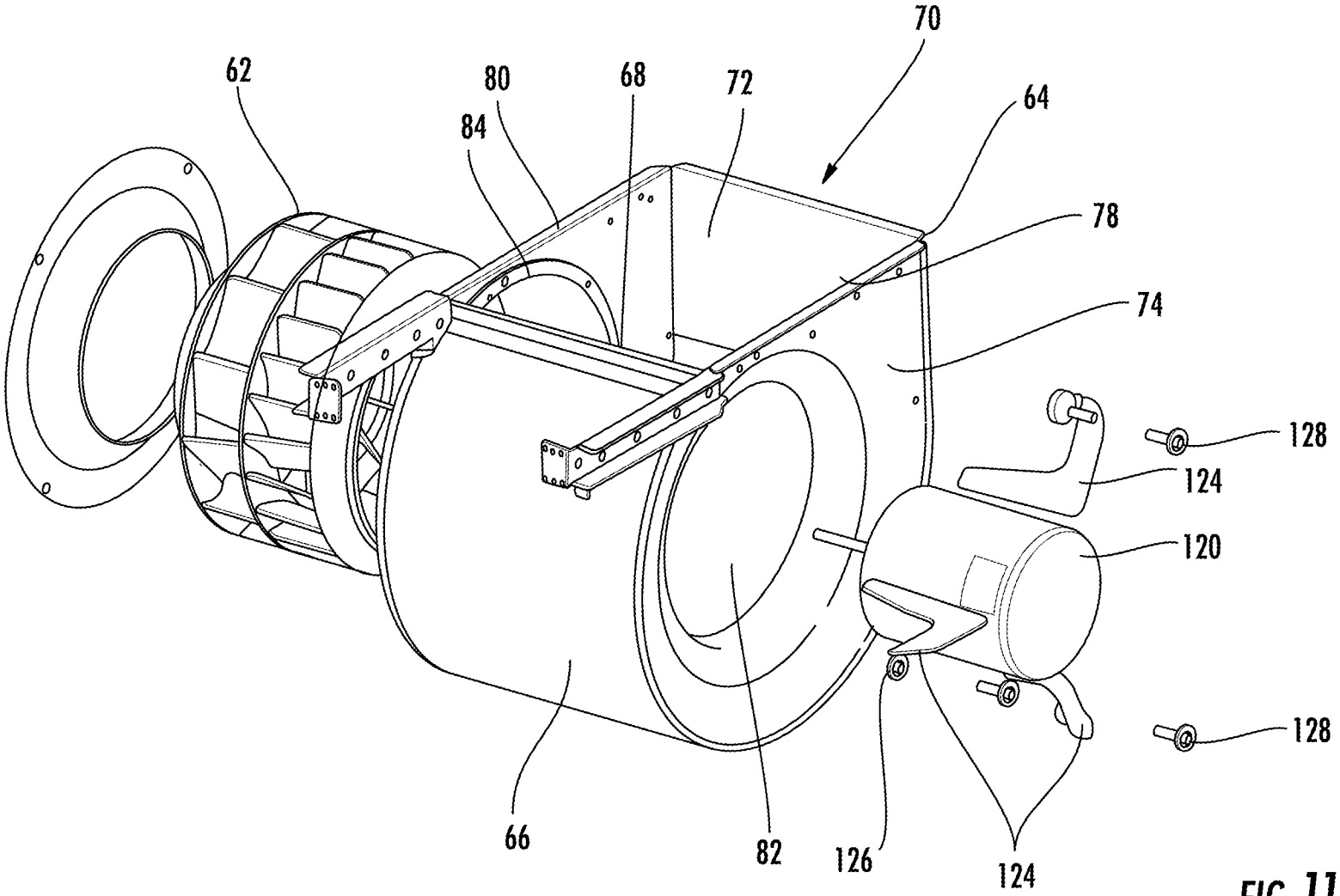
FIG. 11 is an exploded perspective view of the blower assembly of FIG. 8 according to an embodiment.

With reference now to FIGS. 8-10, a motor 120 coupled to the fan wheel 62 is operable to drive rotation of the fan wheel 62 about an axis X to draw ambient air into the blower assembly 52. The first plurality of impeller blades 100 defines a cavity 122 (best shown in FIG. 3) within the first wheel portion 92. For example, a diameter of the cavity 122 is defined between opposing impeller blades 100, and the depth of the cavity 122 is defined by the length of the plurality of impeller blades 100 measured parallel to the axis of rotation. In an embodiment, the cavity 122 is sized to receive at least a portion of the motor 120. As shown, the motor 120 may extend through the opening 82 formed in the sidewall 74 and into the cavity 122. One or more brackets 124 may be used to mount the motor 120 to the adjacent sidewall 74 of the blower housing 64. The plurality of brackets 124 may be equidistantly spaced about the periphery of the motor 120. In the illustrated, non-limiting embodiment, three L-shaped brackets 124 are integrally formed with the motor 120. A flange 126 arranged at an end of each bracket 124 is configured to align with the adjacent sidewall 74 such that a fastening mechanism 128 may couple the bracket 124 thereto. Although the fastening mechanism 128 illustrated is a screw or bolt, other suitable fastening mechanisms are also contemplated herein. Further, it should be understood that although the motor is illustrated and described as being positioned within a cavity formed in the first wheel portion, embodiments where the second wheel portion is adapted to receive a portion of the motor are also within the scope of the disclosure.

The blower assembly 52 illustrated and described herein has an improved efficiency compared to conventional blower assemblies. In addition, the blower assembly 52 may be adapted for use in the blower portion 34 of existing furnaces 20 without requiring modification of the cabinet or housing.

Embodiment 1: A blower assembly comprising: a blower housing; a fan wheel mounted within the blower housing and being rotatable about an axis of rotation, the fan wheel including: a support disk positioned near a center of the fan wheel; a first wheel portion having a first plurality of impeller blades, the first wheel portion being positioned adjacent a first side of the support disk; and a second wheel portion having a second plurality of impeller blades, the second wheel portion being positioned adjacent a second side of the support disk, wherein the first wheel portion and the second wheel portion are asymmetrical about a plane oriented perpendicular to the axis of rotation and intersecting the support disk.

Embodiment 2: The blower assembly according to embodiment 1, wherein at least one of a number of impeller blades, a blade angle, blade height, inlet diameter, and chord of the first wheel portion is different than the second wheel portion.

Embodiment 3: The blower assembly according to embodiment 1, wherein a configuration of the first wheel portion is optimized for integration with a motor and a configuration of the second wheel portion is optimized for maximum fan efficiency.

Embodiment 4: The blower assembly according to embodiment 3, wherein the first plurality of impeller blades is greater in number than the second plurality of impeller blades.

Embodiment 5: The blower assembly according to embodiment 3, wherein a blade angle of the first plurality of impeller blades is greater than a blade angle of the second plurality of impeller blades.

Embodiment 6: The blower assembly according to embodiment 3, wherein an inlet diameter defined by the first plurality of impeller blades is greater than an inlet diameter defined by the second plurality of impeller blades.

Embodiment 7: The blower assembly according to any of the preceding embodiments, wherein at least one of the first plurality of impeller blades and the second plurality of impeller blades has a backward curved configuration.

Embodiment 8: The blower assembly according to any of the preceding embodiments, wherein the first plurality of impeller blades includes between about 8 and about 19 impeller blades.

Embodiment 9: The blower assembly according to any of the preceding embodiments, wherein the first plurality of impeller blades has an outlet blade angle between 35° and 55°.

Embodiment 10: The blower assembly according to any of the preceding embodiments, wherein the first wheel portion has a diameter ratio between about 0.6 and about 0.8.

Embodiment 11: The blower assembly according to any of the preceding embodiments, wherein the first plurality of impeller blades have a blade height ratio between about 1.2 and 1.8.

Embodiment 12: The blower assembly according to any of the preceding embodiments, wherein the first plurality of impeller blades have a thickness between about 2 mm and about 5 mm.

Embodiment 13: The blower assembly according to any of the preceding embodiments, wherein the second plurality of impeller blades includes between about 15 and about 30 impeller blades.

Embodiment 14: The blower assembly according to any of the preceding embodiments, wherein the second plurality of impeller blades has an outlet blade angle between 45° and 75°.

Embodiment 15: The blower assembly according to any of the preceding embodiments, wherein the second wheel portion has a diameter ratio between about 0.7 and about 0.9.

Embodiment 16: The blower assembly according to any of the preceding embodiments, wherein the second plurality of impeller blades have a blade height ratio between about 1.0 and about 1.6.

Embodiment 17: The blower assembly according to any of the preceding embodiments, wherein the second plurality of impeller blades have a thickness between about 2 mm and about 5 mm.

Embodiment 18: The blower assembly according to any of the preceding embodiments, further comprising a first shroud ring coupled to a distal end of the first plurality of impeller blades.

Embodiment 19: The blower assembly according to any of the preceding embodiments, further comprising a second shroud ring coupled to a distal end of the second plurality of impeller blades.

Embodiment 20: The blower assembly according to any of the preceding embodiments, wherein the first shroud ring includes a plurality of openings configured to receive the distal end of the first plurality of impeller blades.

Embodiment 21: The blower assembly according to any of the preceding embodiments, wherein the distal end of the first plurality of impeller blades includes a feature complementary to the plurality of openings such that when the feature is inserted into an opening movement of the first impeller blade is restricted.

Embodiment 22: The blower assembly according any of the preceding embodiments, further comprising a motor for driving rotation of the fan wheel about an axis, wherein the first wheel portion defines a cavity within which a portion of the motor is received.

Embodiment 23: The blower assembly according to embodiment 22, wherein a plurality of mounting brackets couple the motor to a sidewall of the blower housing.

Embodiment 24: The blower assembly according to any of the preceding embodiments, wherein the blower is a portion of a furnace or an air handling unit.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

The invention claimed is:

1. A blower assembly comprising:

a blower housing;

a fan wheel mounted within the blower housing and being rotatable about an axis of rotation, the fan wheel including:

a support disk positioned near a center of the fan wheel;

a first wheel portion having a configuration optimized for integration with a motor, the first wheel portion having a first plurality of impeller blades, the first wheel portion being positioned adjacent a first side of the support disk; and a second wheel portion having a configuration optimized for optimized for maximum fan efficiency, the second wheel portion having a second plurality of impeller blades, the second wheel portion being positioned adjacent a second side of the support disk;

wherein the first plurality of impeller blades is greater than the second plurality of impeller blades such that the first wheel portion and the second wheel portion are asymmetrical about a plane oriented perpendicular to the axis of rotation and intersecting the support disk.

2. The blower assembly according to claim 1, wherein at least one of, a blade angle, blade height, inlet diameter, and chord of the first wheel portion is different than the second wheel portion.

3. The blower assembly according to claim 1, wherein an outlet blade angle of the first plurality of impeller blades is greater than an outlet blade angle of the second plurality of impeller blades.

4. The blower assembly according to claim 1, wherein an inlet diameter defined by the first plurality of impeller blades is greater than an inlet diameter defined by the second plurality of impeller blades.

5. The blower assembly according to claim 1, wherein at least one of the first plurality of impeller blades and the second plurality of impeller blades has a backward curved configuration.

6. The blower assembly according to claim 1, wherein the first plurality of impeller blades includes between 8 and 19 impeller blades.

7. The blower assembly according to claim 1, wherein the first plurality of impeller blades have an outlet blade angle between 35° and 55°.

8. The blower assembly according to claim 1, wherein the first wheel portion has a diameter ratio between 0.6 and 0.8.

9. The blower assembly according to claim 1, wherein the first plurality of impeller blades have a blade height ratio between 1.2 and 1.8.

10. The blower assembly according to claim 1, wherein the first plurality of impeller blades have a thickness between 2 mm and 5 mm.

11. The blower assembly according to claim 1, wherein the second plurality of impeller blades includes between 15 and 30 impeller blades.

12. The blower assembly according to claim 1, wherein the second plurality of impeller blades have an outlet blade angle between 45° and 75°.

13. The blower assembly according to claim 1, wherein the second wheel portion has a diameter ratio between 0.7 and 0.9.

14. The blower assembly according to claim 1, wherein the second plurality of impeller blades have a blade height ratio between 1.0 and 1.6.

15. The blower assembly according to claim 1, wherein the second plurality of impeller blades have a thickness between 2 mm and 5 mm.

16. The blower assembly according to claim 1, further comprising a first shroud ring coupled to a distal end of the first plurality of impeller blades.

17. The blower assembly according to claim 16, wherein the first shroud ring includes a plurality of openings configured to receive the distal end of the first plurality of impeller blades.

18. The blower assembly according to claim 17, wherein the distal end of the first plurality of impeller blades includes a feature complementary to the plurality of openings such that when the feature is inserted into an opening movement of the first plurality of impeller blades is restricted.

19. The blower assembly according to claim 1, further comprising a second shroud ring coupled to a distal end of the second plurality of impeller blades.

20. The blower assembly according to claim 1, further comprising a motor for driving rotation of the fan wheel about an axis, wherein the first wheel portion defines a cavity within which a portion of the motor is received.

21. The blower assembly according to claim 20, wherein a plurality of mounting brackets couple the motor to a sidewall of the blower housing.

22. The blower assembly according to claim 1, wherein the blower is a portion of a furnace or an air handling unit.

* * * * *